US010598467B1

(12) United States Patent
McDermit et al.

(10) Patent No.: US 10,598,467 B1
(45) Date of Patent: Mar. 24, 2020

(54) MULTIPLE SHOT PROJECTILE STUN GUN WITH AUTOMATIC AND SEMI-AUTOMATIC FIRING CAPABILITY

(71) Applicant: Nova Products, Inc, Ponte Vedra Beach, FL (US)

(72) Inventors: John Howard McDermit, Ponte Vedra Beach, FL (US); Jason Edward Havens, Ponte Vedra Beach, FL (US)

(73) Assignee: NOVA PRODUCTS, INC, Ponte Vedra Beach, FL (US)

( * ) Notice: Subject to any disclaimer, the term of this patent is extended or adjusted under 35 U.S.C. 154(b) by 297 days.

(21) Appl. No.: 15/667,490

(22) Filed: Aug. 2, 2017

(51) Int. Cl.
*H01T 23/00* (2006.01)
*F41H 13/00* (2006.01)

(52) U.S. Cl.
CPC ..... *F41H 13/0025* (2013.01)

(58) Field of Classification Search
None
See application file for complete search history.

(56) References Cited

U.S. PATENT DOCUMENTS 4,697,496 A * 10/1987 Goldin ..... F41A 9/35 89/1.41
7,950,176 B1 * 5/2011 Nemtyshkin ..... F41H 13/0025 361/232
8,561,343 B2 * 10/2013 Bunker ..... A01M 1/02 102/267
8,567,378 B2 * 10/2013 Nugent ..... F41B 11/55 124/56
8,893,697 B2 * 11/2014 Foeller ..... F41B 15/02 124/62

* cited by examiner

*Primary Examiner* — Stephen W Jackson

(57) ABSTRACT

Disclosed herein is a multiple shot projectile stun gun. The multiple shot projectile stun gun may include a dual-barrel stun gun comprising a first barrel and a second barrel. Further, the multiple shot projectile stun gun may include a magazine and a magazine-receiving cavity. Further, the magazine may include a first clip assembly and a second clip assembly, each including a tubular body and a drive mechanism. The tubular body may include an open end and a closed end. Further, the drive mechanism may be positioned within the tubular body. Furthermore, the tubular body of the first clip assembly may be laterally connected along the tubular body of the second clip assembly. Additionally, the open end of the first clip assembly may be positioned coincident with the first barrel. Further, the open end of the second clip assembly may be positioned coincident with the second barrel.

10 Claims, 20 Drawing Sheets

MULTIPLE SHOT PROJECTILE STUN GUN WITH AUTOMATIC AND SEMI-AUTOMATIC FIRING CAPABILITY

FIELD OF INVENTION

The present disclosure generally relates to projectile stun guns. More specifically, the disclosure relates to a multiple shot projectile stun gun with automatic and semi-automatic firing capability.

BACKGROUND OF THE INVENTION

Projectile stun guns have traditionally been capable of one or two shots with over 99% of current units in use only capable of a single shot without reloading. The design of the cartridges has changed very little over 30 years. The limitations imposed by the cartridge design require the projectiles to have a barb that allows a trailing wire to be attached to clothing or to penetrate the flesh of the target. This new invention of the projectile stun gun, including the cartridges, a dual delivery cartridge handling system, and the electronics for the generation and delivery of the high voltage, low amperage charge to the target has been designed and demonstrated. This new generation of projectile stun guns will operate much like conventional automatic and semi-automatic firearms with no limitations on the number of shots fired other than the number of cartridges available in the stun gun magazine. The projectiles can either have a barb for attachment, or with the features of the new generation of projectile stun guns and their cartridges, one can incapacitate an individual using projectiles that do not penetrate the flesh. Further, the propulsion for stun gun projectiles has traditionally been either the direct use of a pyrotechnic or the indirect use of a pyrotechnic to rupture a compressed gas container whereas this new generation has a number of "ammunition" options that use pyrotechnics, compressed springs and other means of energy storage to propel the projectiles.

All current projectile stun guns use circuitry that is similar to the well-established technology of Cover (patent Ser. No. 05/270,411) whereby a high voltage, low amperage, pulsating electrical current is used in the incapacitation of humans and other animals.

Projectile stun guns have been in use for over 30 years since the invention by Cover. Cover discovered that a high voltage low amperage electrical charge applied to the human body on the order of about 5 to 20 pulses per second could incapacitate most individuals. (Studies in Russia have also supported very high pulse rates being effective. The authors speculation is that if there is a natural frequency in the nervous system that is optimum for projectile stun guns to incapacitate a human, and perhaps integer multiples of such a "resonate frequency" may also be effective.) Since Covers' initial invention there been numerous designs of the projectile stun gun, however, the electrical charge delivered and the delivery system have been very similar, with the greatest change being to add electronic features and to increase the output by increasing it be a factor of about 4 to 5. Most all units currently in the marketplace produce an open air display discharge of around 50,000 votes more or less using an open air gap on the order of one inch. Pulse rates are usually in the 10 to 20 pulses per second range with some studies indicating that 19 pulses per second might be near optimum. The amperage for each pulse is usually on the order of a few milliamps. The wattage of the units has ranged from the traditional 4 up to 6 W, to modern units which claim to deliver as much as 25 Watts. Modern electronics have allowed the wave form of the discharge to the manipulated and claims are made that this increases the effectiveness of the projectile stun gun. The cartridges have remained almost static in their design in that they rely upon a barb for attachment to clothing or flesh that has a trailing wire to the projectile through which to conduct the electrical current. The wire has been wound in a FIG. 8 configuration to allow for the wire to be dispensed with the projectile without entanglement. The trailing wire is completely dispensed at the firing and is free to fall on the floor which may or may not result in short-circuiting depending upon the integrity of the insulation. Further since two projectiles are required, both of the projectiles along with the trailing wire and means of propulsion for the projectiles has traditionally been a single unit to make up a cartridge.

Accordingly, there is a need for improved projectile stun guns that may overcome one or more of the abovementioned drawbacks.

SUMMARY OF THE INVENTION

In accordance with the purposes of the invention, as embodied and broadly described herein, the disclosure, in some aspects, relates to a multiple shot projectile stun gun with automatic and semi-automatic firing capabilities. The multiple shot projectile stun gun may include a dual-barrel stun gun comprising a first barrel and a second barrel. Further, the multiple shot projectile stun gun may include a magazine and a magazine-receiving cavity. The magazine may be attached into the magazine-receiving cavity. Further, the magazine may include a first clip assembly and a second clip assembly. Additionally, the first clip assembly and the second clip assembly may each include a tubular body and a drive mechanism. The tubular body may include an open end and a closed end. Further, the drive mechanism may be positioned within the tubular body. Additionally, the drive mechanism may be connected adjacent to the closed end. Further, the open end of the first clip assembly may be positioned coincident with the closed end of the second clip assembly. Furthermore, the tubular body of the first clip assembly may be laterally connected along the tubular body of the second clip assembly. Further, the magazine-receiving cavity may traverse perpendicular into the first barrel and the second barrel. Additionally, the open end of the first clip assembly may be positioned coincident with the first barrel. Further, the open end of the second clip assembly may be positioned coincident with the second barrel.

In further aspects, the disclosure also relates to a multiple shot projectile stun gun with automatic and semi-automatic firing capabilities. The multiple shot projectile stun gun may include the first clip assembly and the second clip assembly, Further, each of the first clip assembly and the second clip assembly may include a plurality of stun cartridges. Additionally, the plurality of stun cartridges may be distributed along the tubular body. Moreover, the plurality of stun cartridges may be positioned in between the drive mechanism and the open end of the tubular body. Further, each of the plurality of stun cartridges in the first clip assembly may be oriented parallel to a first barrel of the dual-barrel stun gun. Furthermore, each of the plurality of stun cartridges in the second clip assembly may be oriented parallel to a second barrel of the dual-barrel stun gun.

Additional aspects of the invention will be set forth in part in the description which follows, and in part will be obvious from the description, or can be learned by practice of the disclosure. The advantages of the disclosure will be realized and attained by means of the elements and combinations particularly pointed out in the appended claims. It is to be understood that both the foregoing general description and the following detailed description are exemplary and explanatory only and are not restrictive of the disclosure, as claimed.

BRIEF DESCRIPTION OF THE DRAWINGS

The accompanying drawings, which are incorporated in and constitute a part of this specification, illustrate several aspects of the invention and together with the description, serve to explain the principles of the invention.

DETAILED DESCRIPTION OF THE INVENTION

Figure 1:
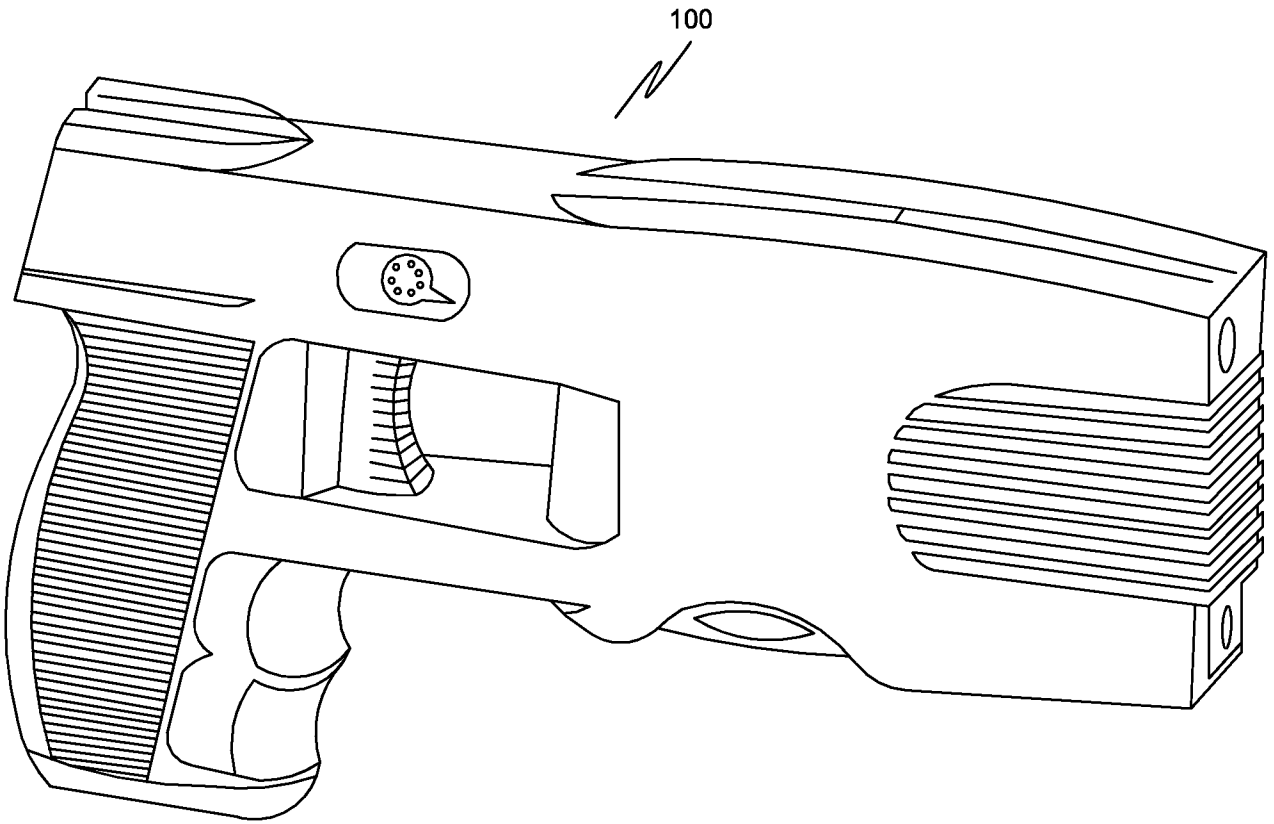
FIG. 1 illustrates a schematic diagram showing a perspective view of a multiple shot projectile stun gun, in accordance with an embodiment.

The present invention can be understood more readily by reference to the following detailed description of the invention and the Examples included therein.

Before the present articles, systems, devices, and/or methods are disclosed and described, it is to be understood that they are not limited to specific manufacturing methods unless otherwise specified, or to particular materials unless otherwise specified, as such can, of course, vary. It is also to be understood that the terminology used herein is for the purpose of describing particular aspects only and is not intended to be limiting. Although any methods and materials similar or equivalent to those described herein can be used in the practice or testing of the present invention, example methods and materials are now described.

Moreover, it is to be understood that unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including: matters of logic with respect to arrangement of steps or operational flow; plain meaning derived from grammatical organization or punctuation; and the number or type of aspects described in the specification.

All publications mentioned herein are incorporated herein by reference to disclose and describe the methods and/or materials in connection with which the publications are cited.

A. Definitions

It is also to be understood that the terminology used herein is for the purpose of describing particular aspects only and is not intended to be limiting. As used in the specification and in the claims, the term "comprising" can include the aspects "consisting of" and "consisting essentially of." Unless defined otherwise, all technical and scientific terms used herein have the same meaning as commonly understood by one of ordinary skill in the art to which this invention belongs. In this specification and in the claims which follow, reference will be made to a number of terms which shall be defined herein.

As used in the specification and the appended claims, the singular forms "a," "an" and "the" include plural referents unless the context clearly dictates otherwise. Thus, for example, reference to "an aperture" includes two or more apertures.

Ranges can be expressed herein as from one particular value, and/or to another particular value. When such a range is expressed, another aspect includes from the one particular value and/or to the other particular value. Similarly, when values are expressed as approximations, by use of the antecedent 'about,' it will be understood that the particular value forms another aspect. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed.

As used herein, the terms "about" and "at or about" mean that the amount or value in question can be the value designated some other value approximately or about the same. It is generally understood, as used herein, that it is the nominal value indicated ±10% variation unless otherwise indicated or inferred. The term is intended to convey that similar values promote equivalent results or effects recited in the claims. That is, it is understood that amounts, sizes, formulations, parameters, and other quantities and characteristics are not and need not be exact, but can be approximate and/or larger or smaller, as desired, reflecting tolerances, conversion factors, rounding off, measurement error and the like, and other factors known to those of skill in the art. In general, an amount, size, formulation, parameter or other quantity or characteristic is "about" or "approximate" whether or not expressly stated to be such. It is understood that where "about" is used before a quantitative value, the parameter also includes the specific quantitative value itself, unless specifically stated otherwise.

The terms "first," "second," "first part," "second part," and the like, where used herein, do not denote any order, quantity, or importance, and are used to distinguish one element from another, unless specifically stated otherwise.

As used herein, the terms "optional" or "optionally" means that the subsequently described event or circumstance can or cannot occur, and that the description includes instances where said event or circumstance occurs and instances where it does not. For example, the phrase "optionally affixed to the surface" means that it can or cannot be fixed to a surface.

Moreover, it is to be understood that unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including: matters of logic with respect to arrangement of steps or operational flow; plain meaning derived from grammatical organization or punctuation; and the number or type of aspects described in the specification.

Disclosed are the components to be used to manufacture the disclosed devices and articles of the invention as well as the materials themselves to be used within the methods disclosed herein. These and other materials are disclosed herein, and it is understood that when combinations, subsets, interactions, groups, etc. of these materials are disclosed that while specific reference of each various individual and collective combinations and permutation of these materials cannot be explicitly disclosed, each is specifically contemplated and described herein. For example, if a particular material is disclosed and discussed and a number of modifications that can be made to the materials are discussed, specifically contemplated is each and every combination and permutation of the material and the modifications that are possible unless specifically indicated to the contrary. Thus, if a class of materials A, B, and C are disclosed as well as a class of materials D, E, and F and an example of a combination material, A-D is disclosed, then even if each is not individually recited each is individually and collectively contemplated meaning combinations, A-E, A-F, B-D, B-E, B-F, C-D, C-E, and C-F are considered disclosed. Likewise, any subset or combination of these is also disclosed. Thus, for example, the sub-group of A-E, B-F, and C-E would be considered disclosed. This concept applies to all aspects of this application including, but not limited to, steps in methods of making and using the articles and devices of the invention. Thus, if there are a variety of additional steps that can be performed it is understood that each of these additional steps can be performed with any specific aspect or combination of aspects of the methods of the invention.

It is understood that the devices and systems disclosed herein have certain functions. Disclosed herein are certain structural requirements for performing the disclosed functions, and it is understood that there are a variety of structures that can perform the same function that are related to the disclosed structures, and that these structures will typically achieve the same result.

B. A Multiple Shot Projectile Stun Gun 100

According to various aspects, the present disclosure relates to a multiple shot projectile stun gun 100 with automatic and semi-automatic firing capabilities. The multiple shot projectile stun gun 100 may include a first barrel 1302*a* and a second barrel 1302*b*. Further, the multiple shot projectile stun gun 100 may include a magazine 302 and a magazine 302-receiving cavity. The magazine 302 may be attached into the magazine 302-receiving cavity. Further, the magazine 302 may include a first clip assembly 304*a* and a second clip assembly 304*b*. Additionally, the first clip assembly 304*a* and the second clip assembly 304*b* may each include a tubular body 308 and a drive mechanism 402. The tubular body 308 may include an open end and a closed end. Further, the drive mechanism 402 may be positioned within the tubular body 308. Additionally, the drive mechanism 402 may be connected adjacent to the closed end. Further, the open end of the first clip assembly 304*a* may be positioned coincident with the closed end of the second clip assembly 304*b*. Furthermore, the tubular body 308 of the first clip assembly 304*a* may be laterally connected along the tubular body 308 of the second clip assembly 304*b*. Further, the magazine 302-receiving cavity may traverse perpendicular into the first barrel 1302*a* and the second barrel 1302*b*. Additionally, the open end of the first clip assembly 304*a* may be positioned coincident with the first barrel 1302*a*. Further, the open end of the second clip assembly 304*b* may be positioned coincident with the second barrel 1302*b*.

Further, in some embodiments, the dual-barrel stun gun 100 may include an elongated housing body, a trigger mechanism 1308, and a grip 1306. Furthermore, the first barrel 1302*a* and the second barrel 1302*b* may be positioned parallel and offset to each other. Additionally, the first barrel 1302*a* and the second barrel 1302*b* may be mounted within and along the elongated housing body. Moreover, the first barrel 1302*a* and the second barrel 1302*b* may be positioned proximal to a first end of the elongated housing body. Further, the grip 1306 may be positioned adjacent to a second end of the elongated housing body. Furthermore, the grip 1306 may be laterally connected to the elongated housing body. Additionally, the trigger mechanism 1308 may be positioned in between the first barrel 1302*a* and the grip 1306. Further, the trigger mechanism 1308 may be mounted to the elongated housing body. Furthermore, the magazine 302-receiving cavity may be positioned adjacent to the trigger mechanism 1308, opposite the grip 1306.

In some embodiments, the dual-barrel stun gun 100 may further include at least one battery. The battery may be mounted within the grip 1306 of the dual-barrel stun gun 100. Further, the battery may be electrically connected to the first clip assembly 304*a*, the second clip assembly 304*b*, and the trigger mechanism 1308 of the dual-barrel stun gun 100.

In some embodiments, the multiple shot projectile stun gun 100 may further include a voltage amplifier circuit. The voltage amplifier circuit may be mounted within the elongated housing body of the dual-barrel stun gun 100. Further, the voltage amplifier circuit may be electrically connected in between the battery and the first clip assembly 304*a*. Additionally, the voltage amplifier circuit may be electrically connected in between the battery and the second clip assembly 304*b*.

In some embodiments, the drive mechanism 402 may include a spring and a follower. Further, the follower may be slidably positioned along and within the tubular body 308. Furthermore, the spring may be connected in between the closed end of the tubular body 308 and the follower.

In further aspects, the disclosure also relates to a multiple shot projectile stun gun 100 with automatic and semi-automatic firing capabilities in accordance with another embodiment. The multiple shot projectile stun gun 100 may include the first clip assembly 304*a* and the second clip assembly 304*b*, Further, each of the first clip assembly 304*a* and the second clip assembly 304*b* may include a plurality of stun cartridges 202. Additionally, the plurality of stun cartridges 202 may be distributed along the tubular body 308. Moreover, the plurality of stun cartridges 202 may be positioned in between the drive mechanism 402 and the open end of the tubular body 308. Further, each of the plurality of stun cartridges 202 in the first clip assembly 304*a* may be oriented parallel to a first barrel 1302*a* of the dual-barrel stun gun 100. Furthermore, each of the plurality of stun cartridges 202 in the second clip assembly 304*b* may be oriented parallel to a second barrel 1302*b* of the dual-barrel stun gun 100.

In some embodiments, each of the plurality of stun cartridges 202 may include a cylindrical body, a trailing wire, a retaining anchor, and a conductive portion. Further, the conductive portion may be adjacently connected to a first end of the cylindrical body. Additionally, the retaining anchor may be adjacently attached to a second end of the cylindrical body. Moreover, the trailing wire may be wound about the cylindrical body from the first end to the second end. Additionally, the retaining anchor may be electrically connected to the conductive portion by the trailing wire.

In some embodiments, the conductive portion may be a barb. Alternatively, and/or additionally, in some embodiments, the conductive portion may be a semi-cylindrical ending.

In some embodiments, the dual-barrel stun gun 100 may further include a first propulsion mechanism and a second propulsion mechanism. Furthermore, the first propulsion mechanism may be mechanically integrated in between the first clip assembly 304*a* and the first barrel 1302*a*. Likewise, the second propulsion mechanism may be mechanically integrated in between the second clip assembly 304*b* and the second barrel 1302*b*. Further, the first propulsion mechanism and the second propulsion mechanism may each be mechanically connected to the trigger mechanism 1308 of the dual-barrel stun gun 100.

In some embodiments, one or more of the first propulsion mechanism and the second propulsion mechanism may be a pyrotechnic-based propulsion.

In some embodiments, one or more of the first propulsion mechanism and the second propulsion mechanism may be a hydraulic-based propulsion.

In some embodiments, one or more of the first propulsion mechanism and the second propulsion mechanism may be a spring-based propulsion.

According to various aspects of the invention, the multiple shot projectile stun gun 100 can comprise multiple configurations. For example, various exemplary embodiments of the inventive multiple shot projectile stun gun 100 are shown in FIGS. 1-20.

FIG. 1 illustrates a schematic diagram showing a perspective view of a multiple shot projectile stun gun 100, in accordance with an embodiment. The stun gun 100 is characterized by a form factor that will accommodate a dual delivery magazine and a number of cartridge designs that can be used with the stun gun 100. Accordingly, the stun gun 100 as shown may accommodate 24 projectiles that would allow 12 shots of the prototype ammunition developed. For most applications for law enforcement, the 12 shot capacity magazine with barbed projectiles is very adequate. However, if one plans to use the projectiles without barbs, much higher capacity magazines will most likely be required. These magazines may be in the form of a banana clip or a drum type magazine.

Figure 2:
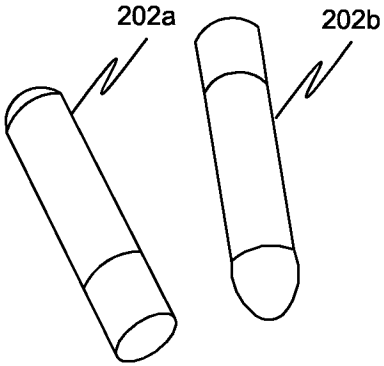
FIG. 2 illustrates a schematic diagram showing ammunition of a multiple shot projectile stun gun without a barb on the projectile, in accordance with an embodiment.

FIG. 2 illustrates a schematic diagram showing cartridge 202 (also referred to herein as ammunition), such as 202*a* and 202*b*, of a multiple shot projectile stun gun 100 without a barb on the projectile, in accordance with an embodiment. This gives one an idea of the compactness of the design and the scale of the cartridge 202.

Figure 3:
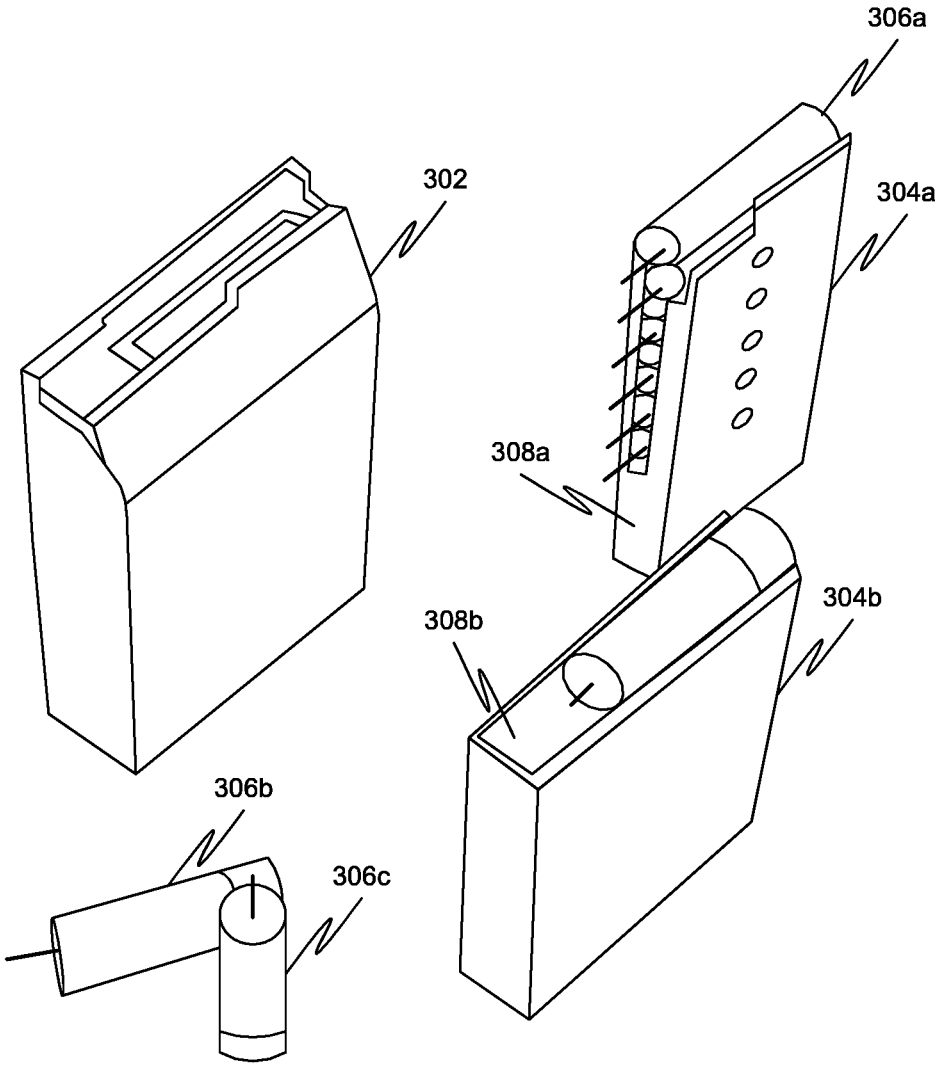
FIG. 3 illustrates a schematic diagram showing a perspective view of a magazine comprising dual clip assemblies for use with a multiple shot projectile stun gun, in accordance with an embodiment.

FIG. 3 illustrates a schematic diagram showing a perspective view of a magazine 302 comprising dual clip assemblies for use with a multiple shot projectile stun gun 100, in accordance with an embodiment. In an instance, the dual delivery magazine 302 may be of a compact projectile design. These projectiles may be on the order of the size of larger caliber side arm ammunition and can support enough trailing wire for a strike distance from 20 feet to 30 feet or more, with longer distances being possible if practical. The compact cartridge design and the dual delivery magazine 302 may be used with the stun gun 100 of the present disclosure. Accordingly, the magazine 302 may include a first clip assembly 304*a* and a second clip assembly 304*b*. Further, each of the first clip assembly 304*a* and second clip assembly 304*b* may be configured to receive a plurality of barbed cartridges 306. Accordingly, each of the first clip assembly 304*a* and second clip assembly 304*b* may include a corresponding tubular body 308*a* and 308*b* respectively configured to receive the barbed cartridges 306.

Figure 4:
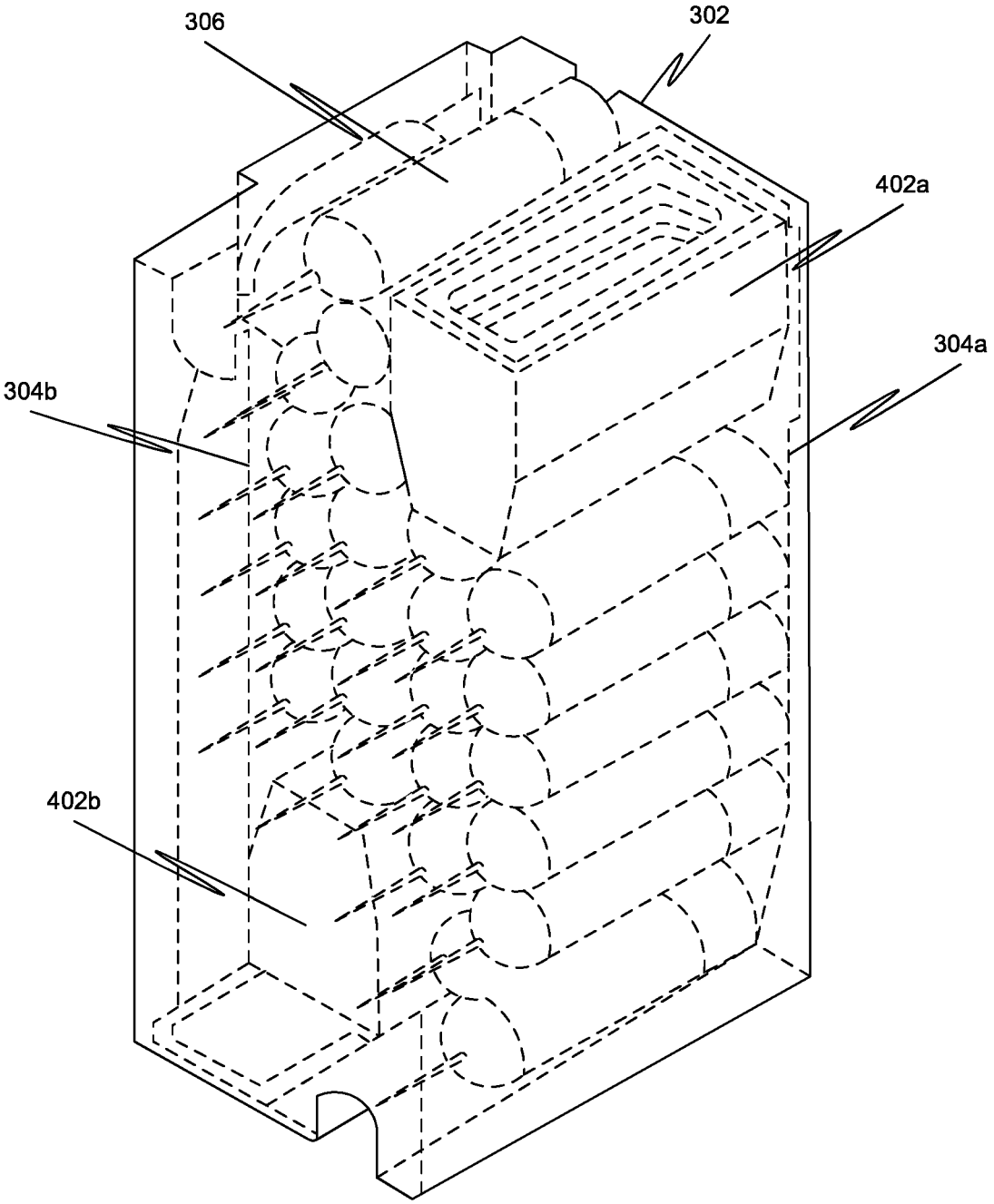
FIG. 4 illustrates a schematic diagram showing a see-through perspective view of a magazine comprising dual clip assemblies for use with a multiple shot projectile stun gun, in accordance with an embodiment.

FIG. 4 illustrates a schematic diagram showing a see-through perspective view of a magazine 302 comprising dual clip assemblies for use with a multiple shot projectile stun gun 100, in accordance with an embodiment. As shown, the magazine 302 includes the first clip assembly 304*a* and second clip assembly 304*b*. Further each clip assembly 304 includes a drive mechanism 402. For example, the first clip assembly 304*a* includes the drive mechanism 402*a*. Similarly, the second clip assembly 304*b* includes the drive mechanism 402*b*. The drive mechanism 402 is configured to drive the plurality of cartridges 306 in a sequential manner. Accordingly, in some embodiments, the drive mechanism 402 may include a spring compressed during loading of the cartridges 306 into the clip assemblies 304. The stored potential energy when released during operation of the stun gun 100 then causes the cartridges to be drive out of the clip assemblies 304 and into the barrel of the stun gun 100 for being fired.

Figure 5:
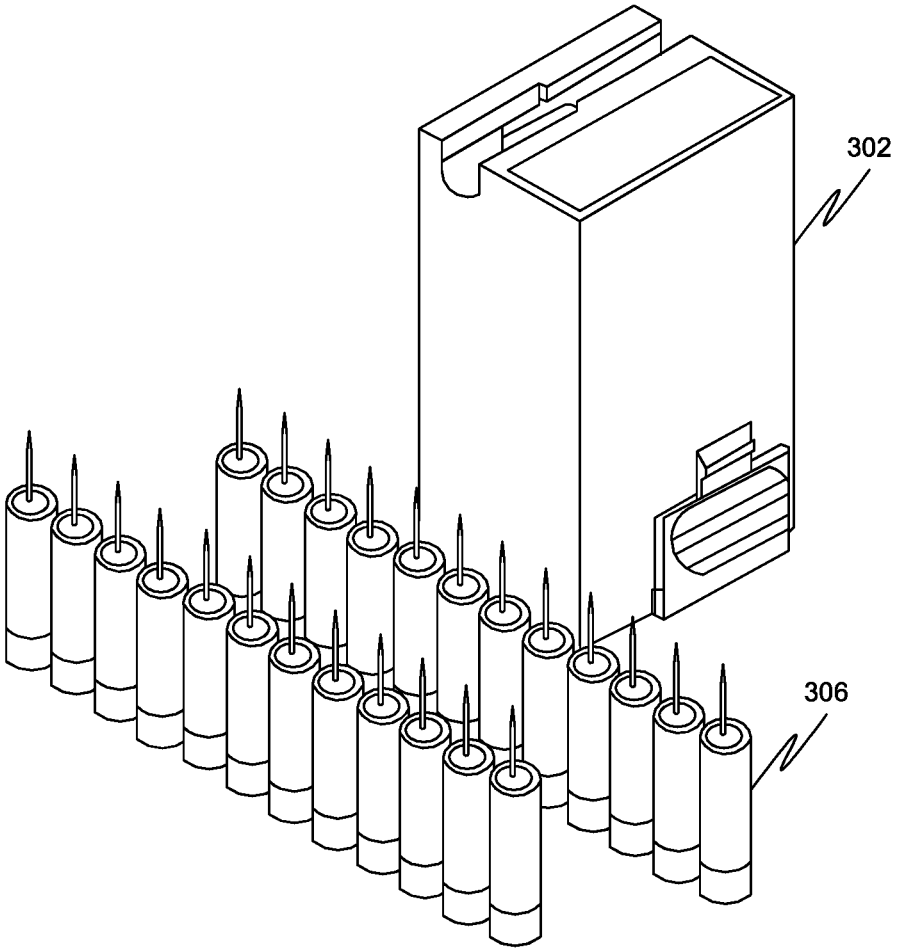
FIG. 5 illustrates a schematic diagram showing a perspective view of a magazine for use with a multiple shot projectile stun gun prior to being loaded by ammunition, in accordance with an embodiment.

FIG. 5 illustrates a schematic diagram showing a perspective view of a magazine 302 for use with a multiple shot projectile stun gun 100 prior to being loaded by ammunition 306, in accordance with an embodiment.

Figure 6:
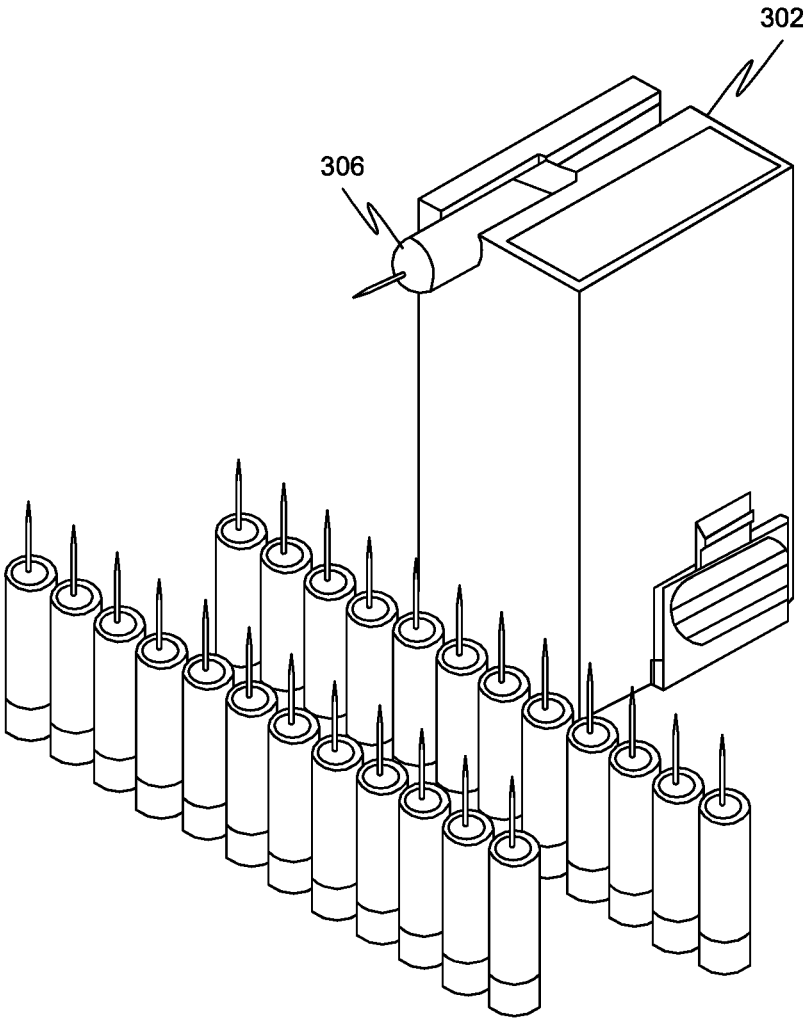
FIG. 6 illustrates a schematic diagram showing a perspective view of a magazine for use with a multiple shot projectile stun gun while being loaded by ammunition, in accordance with an embodiment.

FIG. 6 illustrates a schematic diagram showing a perspective view of a magazine 302 for use with a multiple shot projectile stun gun 100 while being loaded by ammunition 306, in accordance with an embodiment.

Figure 7:
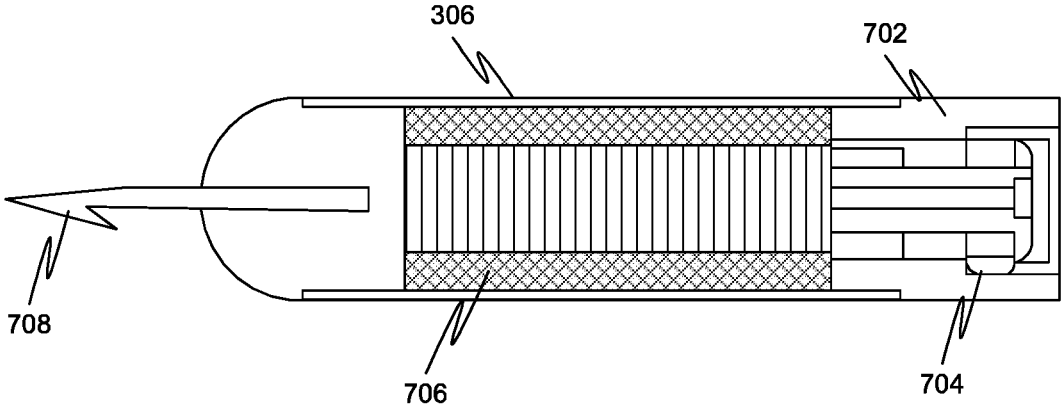
FIG. 7 illustrates a schematic diagram showing a cross-sectional view of ammunition for use with a multiple shot projectile stun gun, in accordance with an embodiment.

FIG. 7 illustrates a schematic diagram showing a cross-sectional view of ammunition 306 (or cartridge 306) for use with a multiple shot projectile stun gun 100, in accordance with an embodiment. The cartridge 306 may include a pallet 702, a primer 704, a wire 706 and a barb 708.

Figure 8:
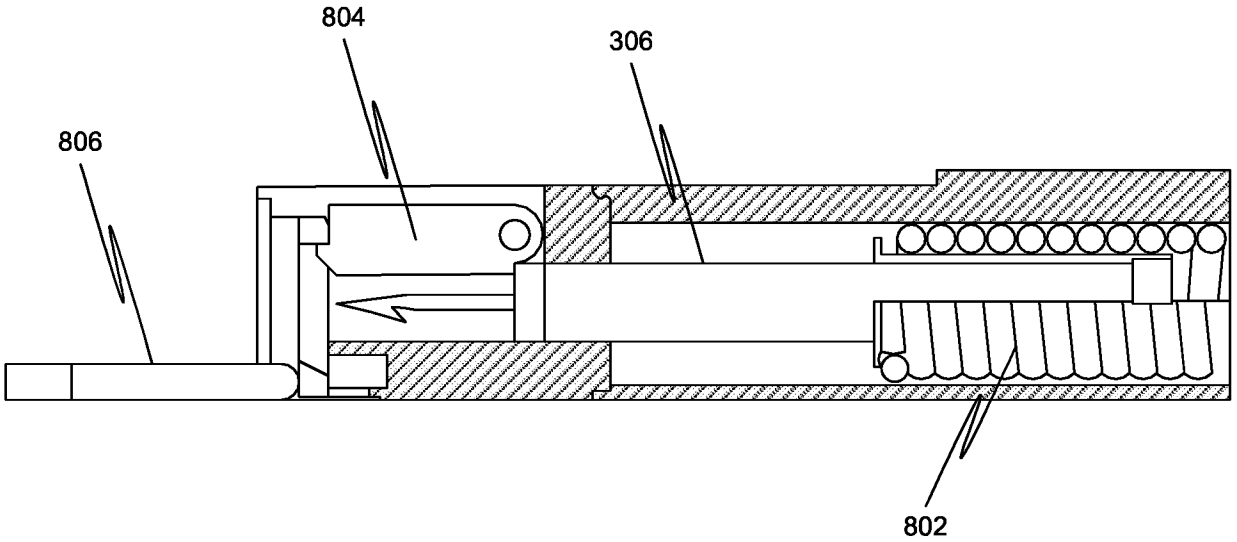
FIG. 8 illustrates a schematic diagram showing a cross-sectional view of a cartridge that uses energy stored in a spring for propulsion for use with a multiple shot projectile stun gun, in accordance with an embodiment.

FIG. 8 illustrates a schematic diagram showing a cross-sectional view of a cartridge 306 that uses energy stored in a spring for propulsion for use with a multiple shot projectile stun gun 100, in accordance with an embodiment. Accordingly, the cartridge 306 may include a spring 802, a mechanical lock 804 and a key 806 associated with the mechanical lock 804 for standby mode and firing actuation.

Figure 9:
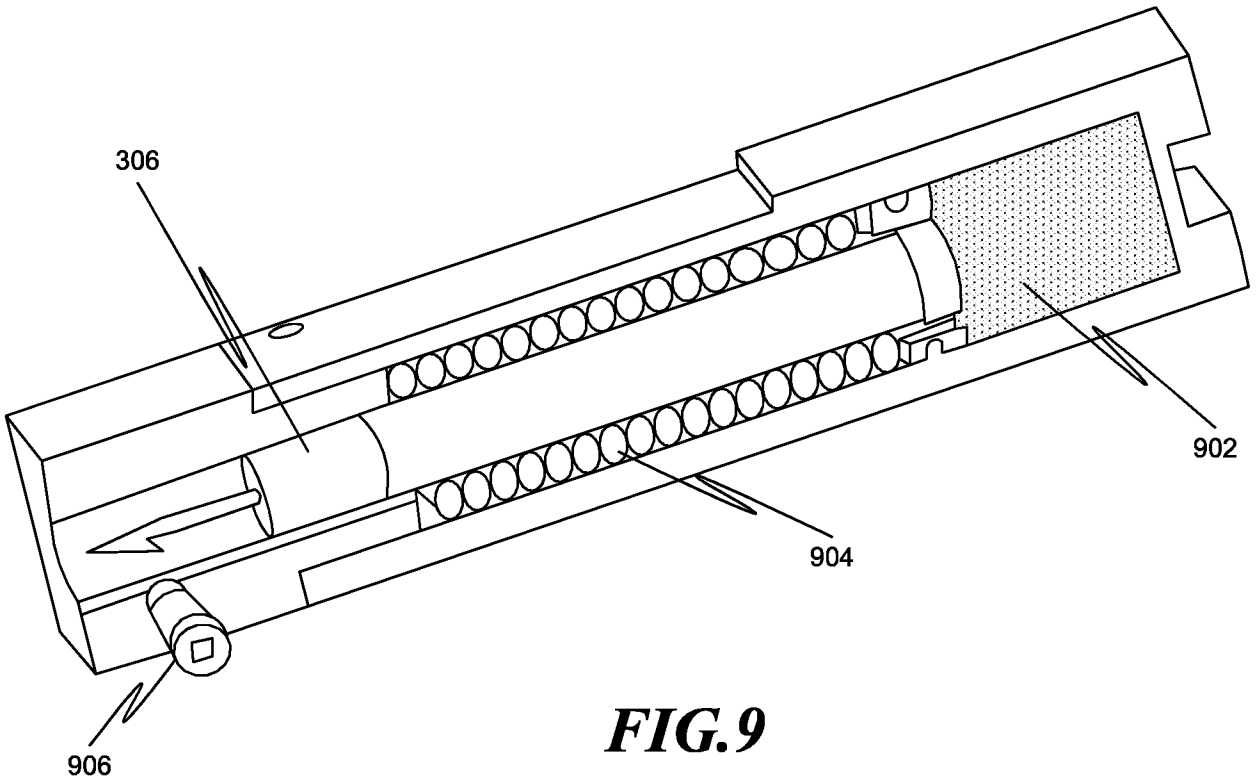
FIG. 9 illustrates a schematic diagram showing a cross-sectional view of a cartridge that uses uses energy stored in a spring, coupled with a liquid to impart force to the projectile for propulsion, in accordance with an embodiment.

FIG. 9 illustrates a schematic diagram showing a cross-sectional view of a cartridge 306 that uses uses energy stored in a spring, coupled with a liquid to impart force to the projectile for propulsion, in accordance with an embodiment. Accordingly, the cartridge 306 may include a liquid 902 stored in a chamber and a spring 904. Additionally, the cartridge 306 may include a lock 906.

Figure 10:
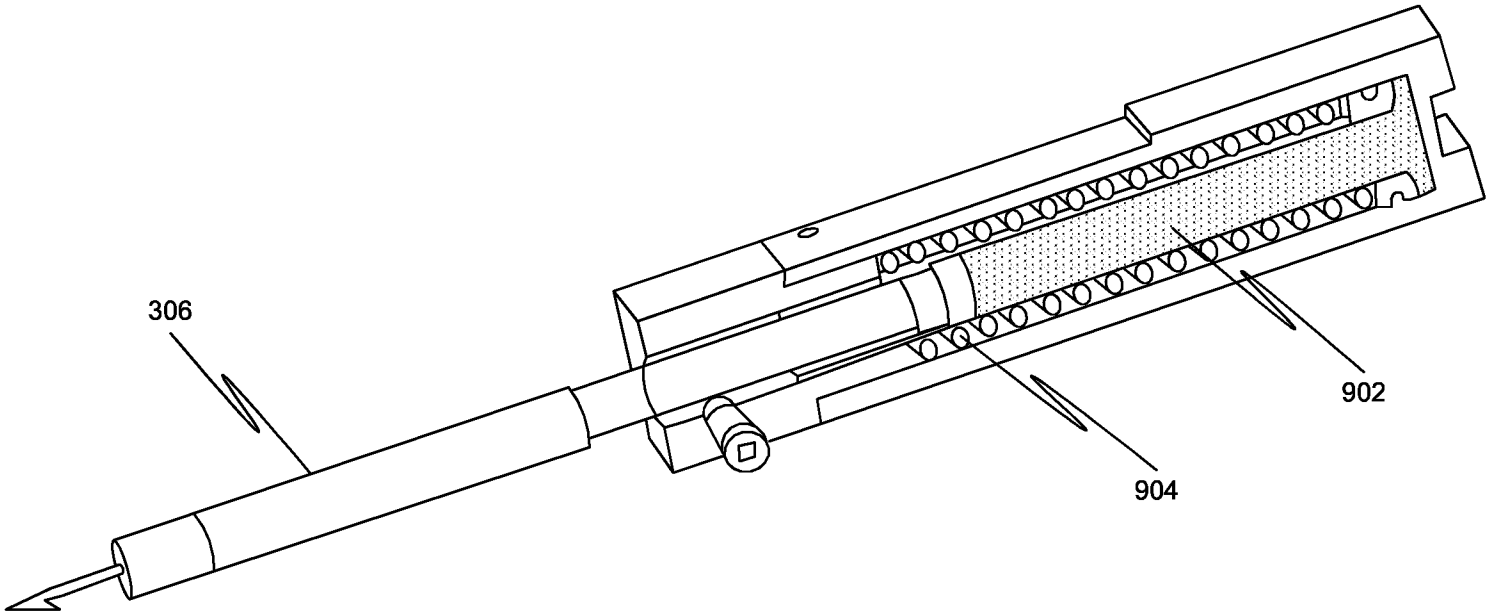
FIG. 10 illustrates a schematic diagram showing a cartridge in firing process, in accordance with an embodiment.

FIG. 10 illustrates a schematic diagram showing a cartridge 306 in firing process, in accordance with an embodiment.

Figure 11:
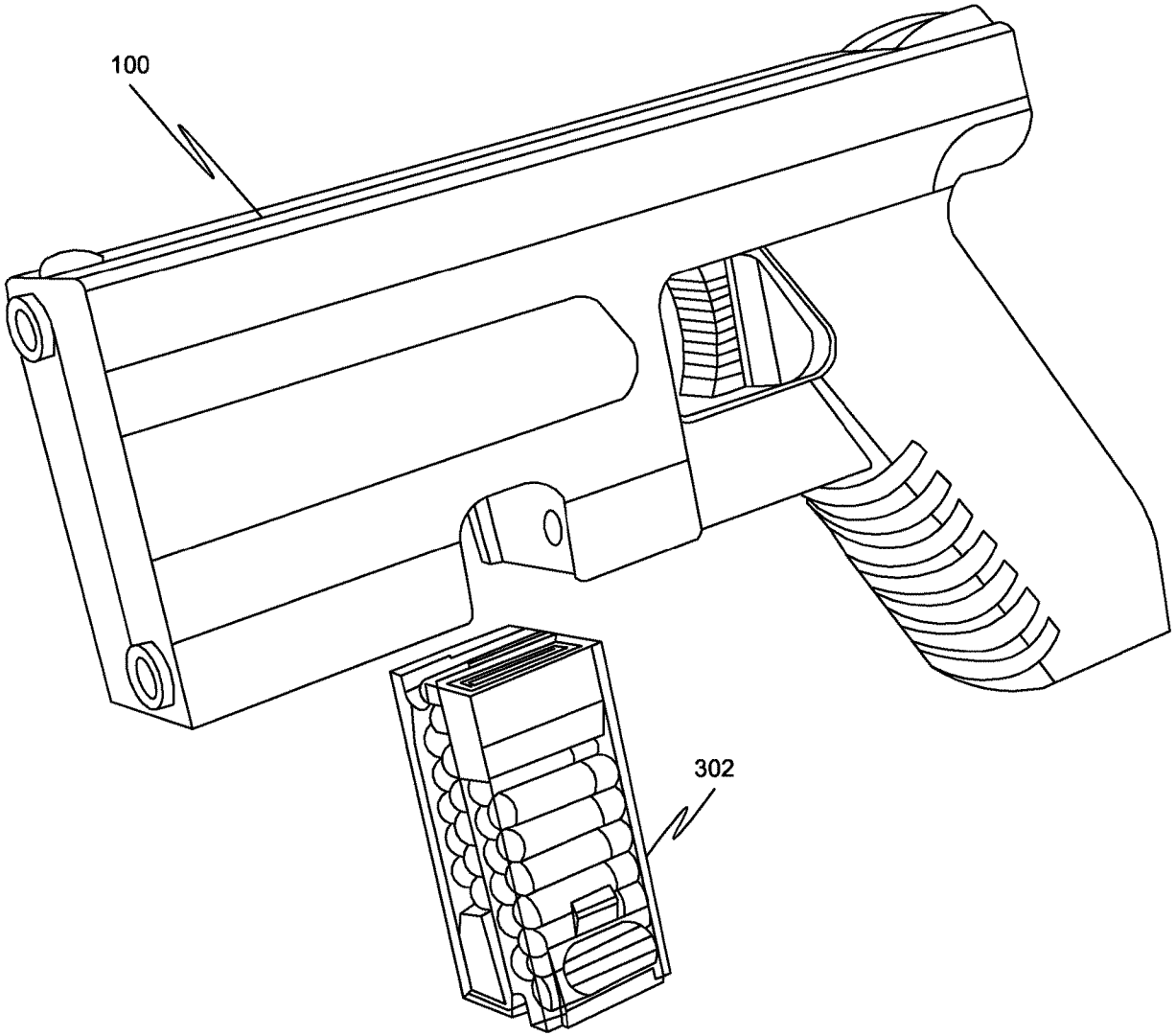
FIG. 11 is an illustration showing loading of the dual delivery magazine into a multiple shot projectile stun gun, in accordance with an embodiment.

FIG. 11 is an illustration showing loading of the dual delivery magazine 302 into a multiple shot projectile stun gun 100, in accordance with an embodiment.

Figure 12:
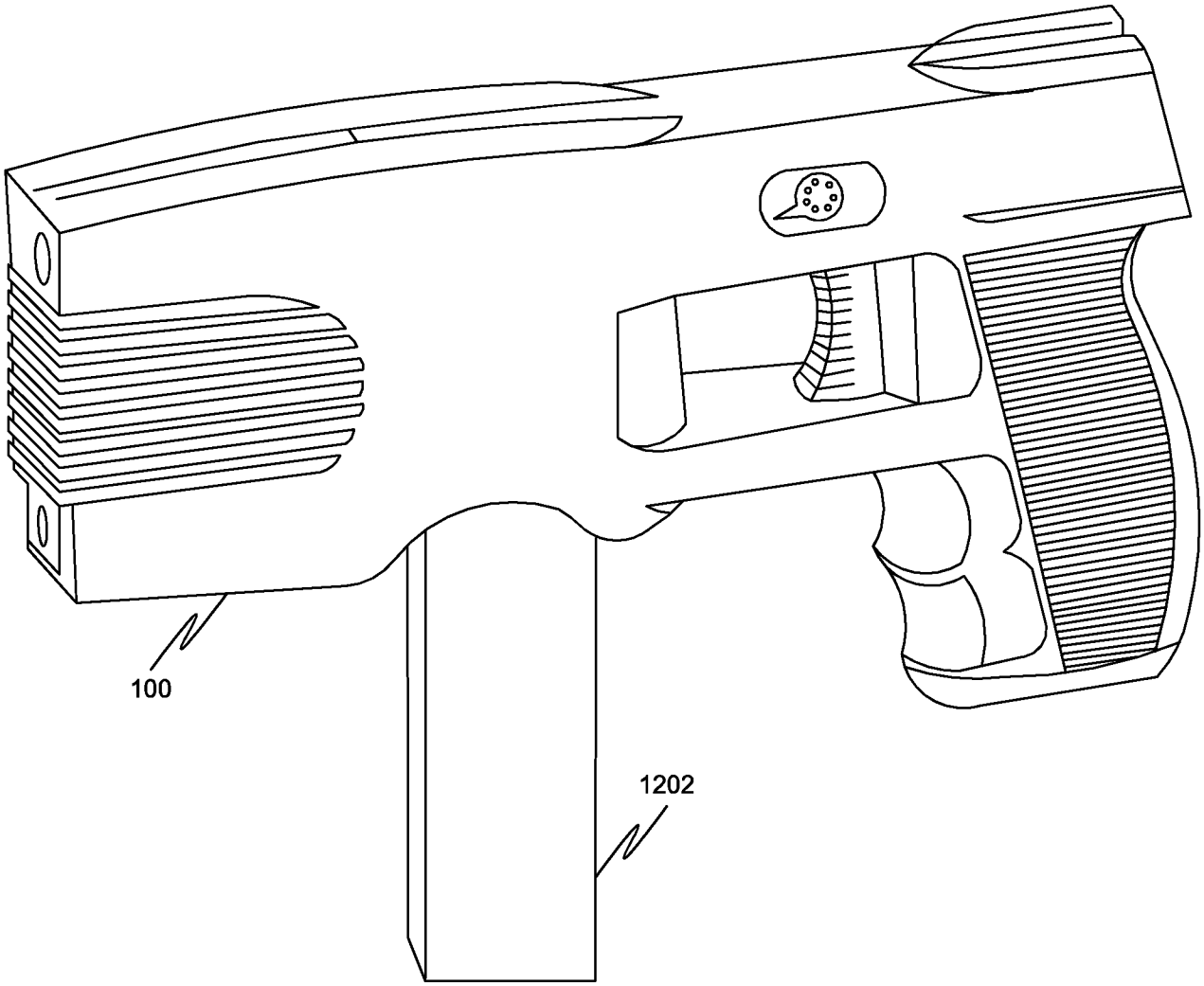
FIG. 12 is an illustration of an extended magazine for automatic fire mode with blunt projectiles, in accordance with an embodiment.

FIG. 12 is an illustration of an extended magazine 1202 for automatic fire mode with blunt projectiles, in accordance with an embodiment. The extended magazine 1202 in some embodiments may be configured to accommodate a larger number of cartridges 202 or 306. Further, in some embodiments, the extended magazine 1202 may be configured to be attached to the magazine 302.

Figure 13:
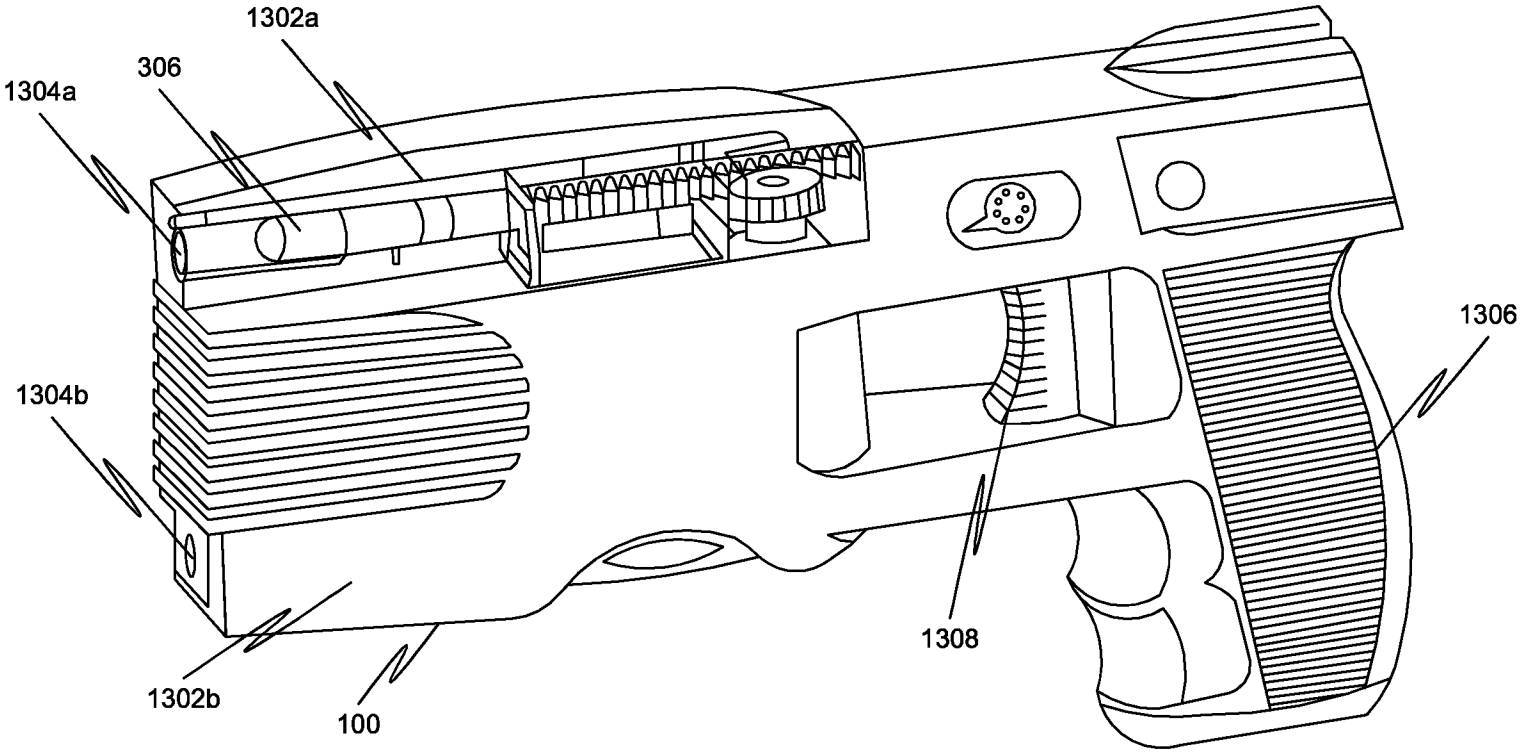
FIG. 13 is an illustration showing a partial see-through view of a multiple shot projectile stun gun showing chambering of an ammo round, in accordance with an embodiment.

FIG. 13 is an illustration showing a partial see-through view of a multiple shot projectile stun gun 100 showing chambering of an ammo round, in accordance with an embodiment. As illustrated, the partial cut away view shows the first barrel 1302*a* of the stun gun 100. Further, the first barrel includes an open end 1304*a*. Similarly, the stun gun 100 also includes a second barrel 1302*b* and a corresponding second open end 1304*b*. Also apparent in the figure are the grip 1306 and the trigger mechanism 1308.

Figure 14:
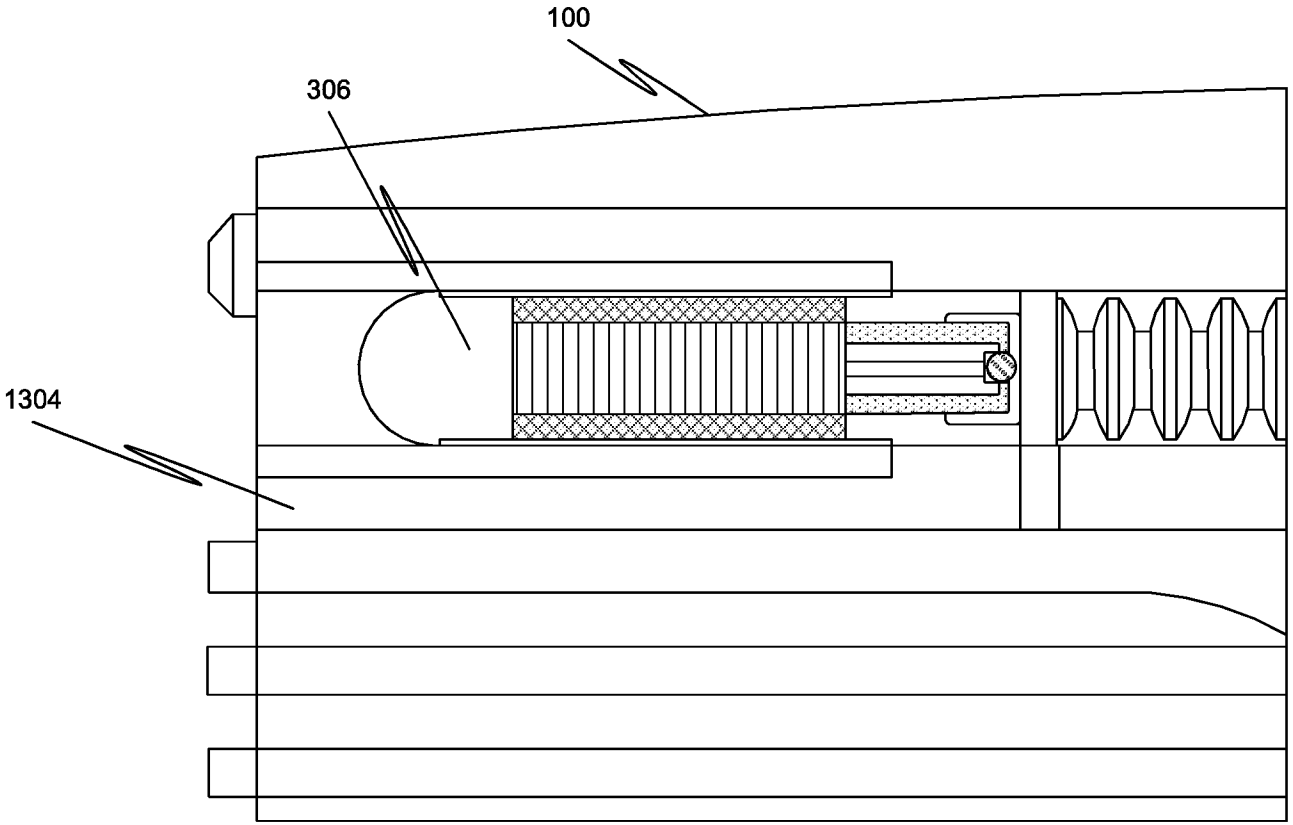
FIG. 14 is an illustration showing a cross sectional view of a cartridge inside a chamber of a multiple shot projectile stun gun, in accordance with an embodiment.

FIG. 14 is an illustration showing a cross sectional view of a cartridge 306 inside a chamber of a multiple shot projectile stun gun 100, in accordance with an embodiment.

Figure 15:
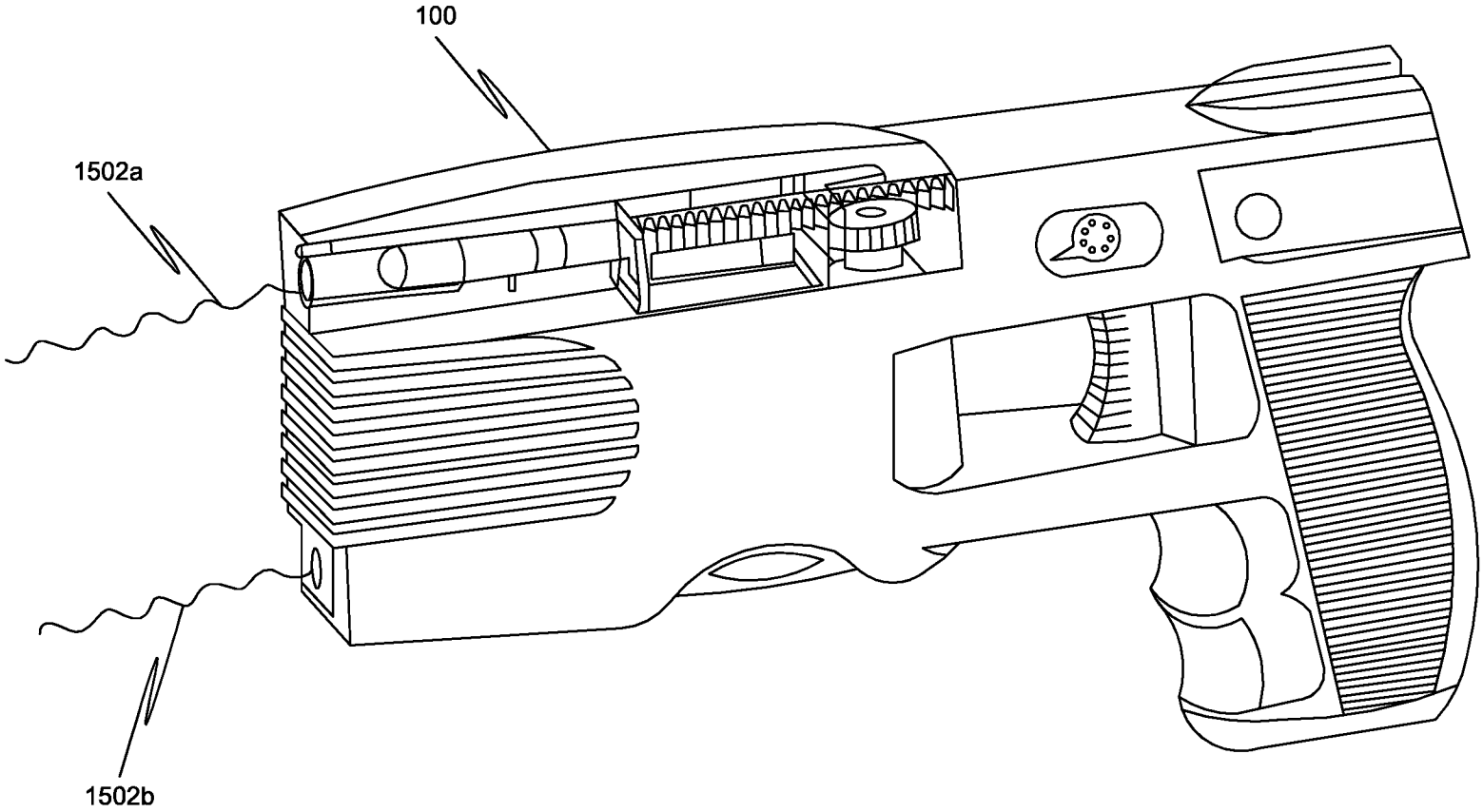
FIG. 15 is an illustration showing a partial see-through view of a multiple shot projectile stun gun showing showing a cartridge in firing process, in accordance with an embodiment.

FIG. 15 is an illustration showing a partial see-through view of a multiple shot projectile stun gun 100 showing showing a cartridge 306 in firing process, in accordance with an embodiment. As shown, upon firing, wires 1502*a* and 1502*b* are unwound and extended while still remaining electrically connected to the stun gun 100 in order to facilitate delivery of electric charge to a target.

Figure 16:
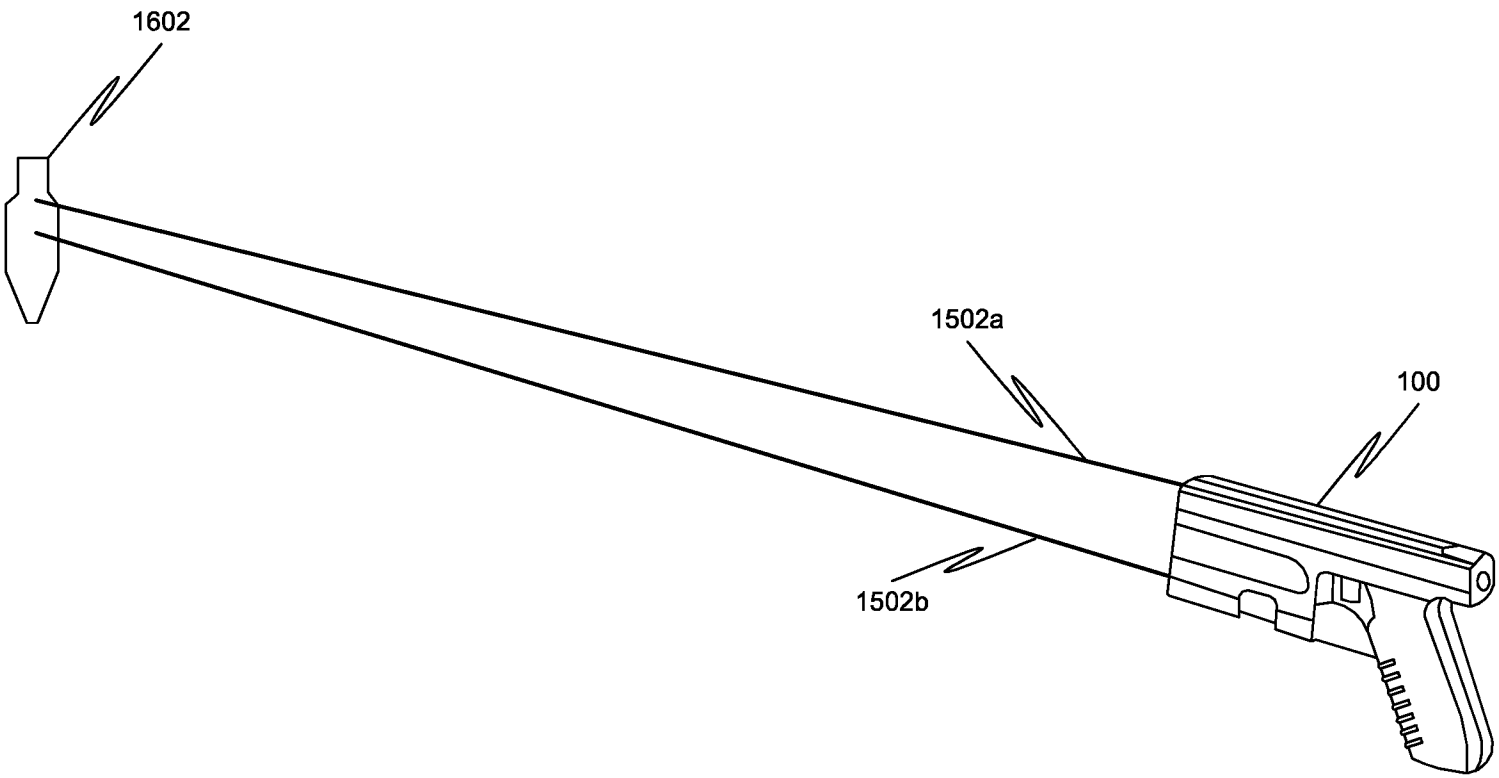
FIG. 16 is an illustration of firing of a multiple shot projectile stun gun with spring-like connecting wires to projectile to prevent entanglement, in accordance with an embodiment.

FIG. 16 is an illustration of firing of a multiple shot projectile stun gun 100 with spring-like connecting wires 1502 to projectile to prevent entanglement, in accordance with an embodiment. Accordingly, cartridges 306 fired towards a target 1602 may cause wires 1502 to unwind and extend out of the stun gun 100 without entangling.

Figure 17:
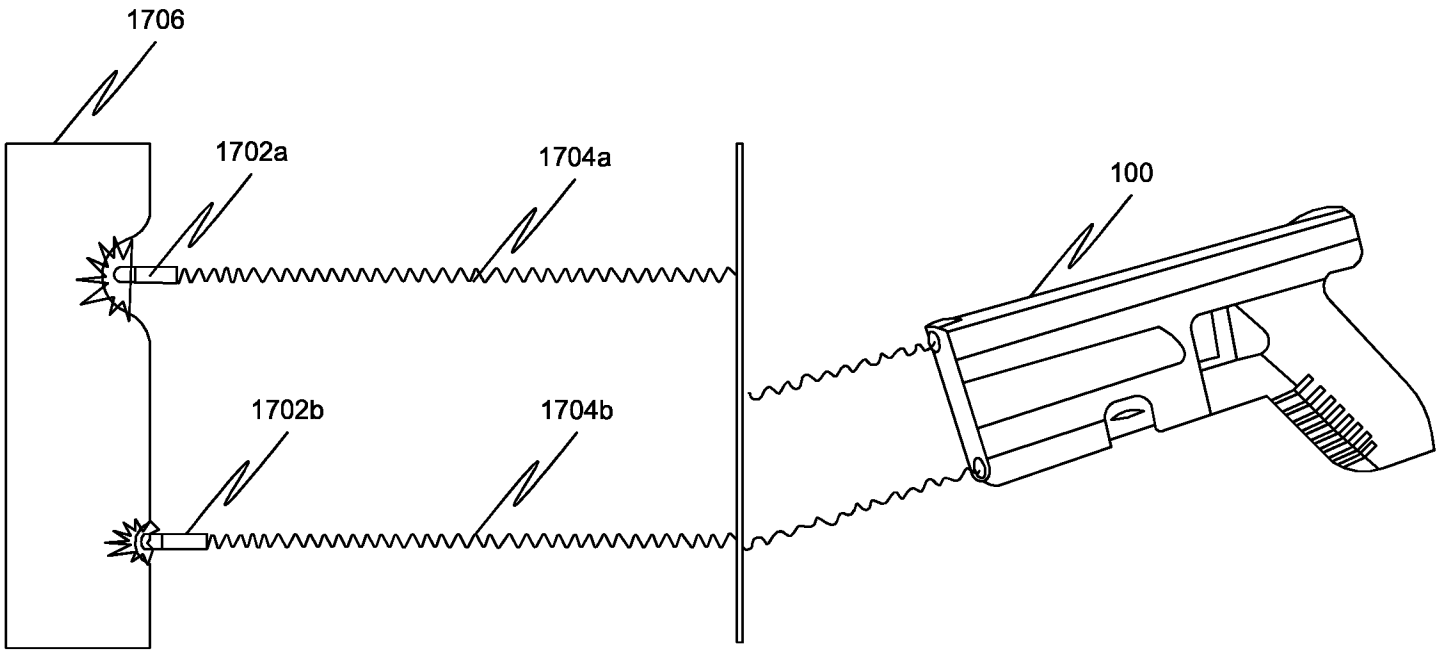
FIG. 17 is an illustration of a blunt projectile fired from a multiple shot projectile stun gun impacting a target, in accordance with an embodiment.

FIG. 17 is an illustration of a blunt projectile 1702 fired from a multiple shot projectile stun gun 100 impacting a target 1706, in accordance with an embodiment. Further, upon firing of the projectile 1702, wires 1704 may be unwound and extended from the stun gun 100 as illustrated. Additionally, in some instances, use of multiple projectiles 1702 (e.g. 1702*a* and 1702*b*) may provide incapacitation of the target even in the event of a failure of one of the projectiles. In other words, electric charge may be delivered to the target as long as at least one wire 1704 remains connected between the target 1706 and the stun gun 100. For example, as shown, wire 1704*a* may be severed prior to delivering the electric charge from the stun gun 100. However, since wire 1704*b* is intact, electric charge may still be delivered to the target 1706.

Figure 18:
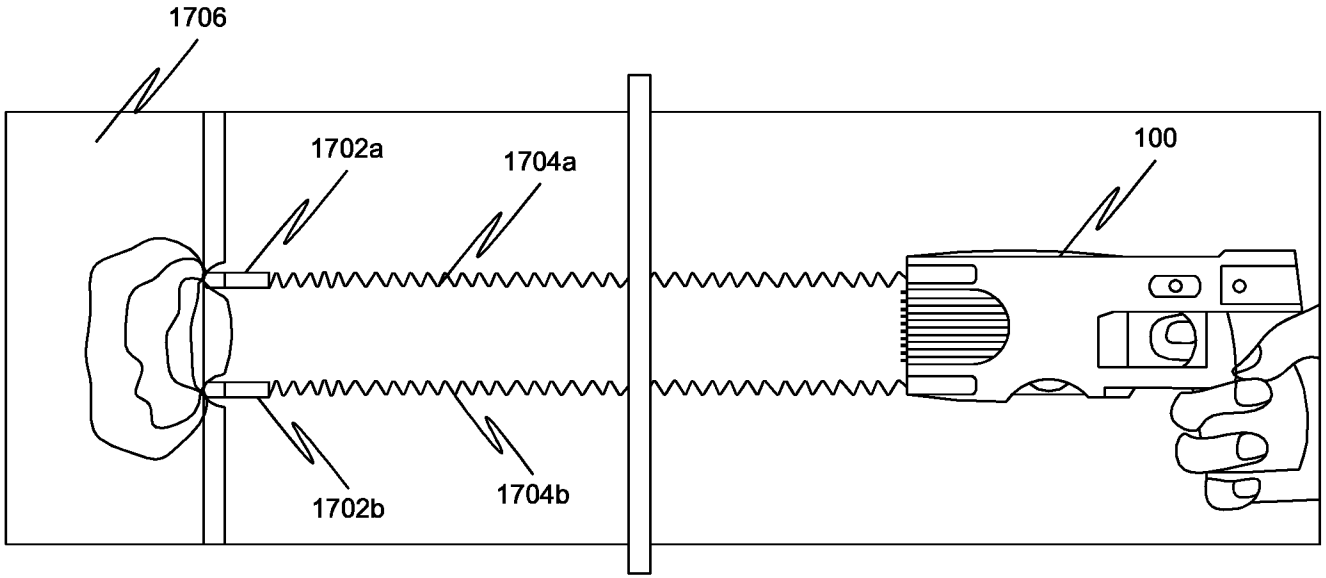
FIG. 18 is an illustration of a discharge of a blunt (or barbed) projectile fired from a multiple shot projectile stun gun into a target, in accordance with an embodiment.

FIG. 18 is an illustration of a discharge of a blunt (or barbed) projectile 1702 fired from a multiple shot projectile stun gun 100 into a target 1706, in accordance with an embodiment. In this instance, both wires 1704*a* and 1704*b* provide an electrical path from the stun gun 100 to the target 1706. Accordingly, a greater incapacitating effect on the target 1706 may be achieved.

Figure 19:
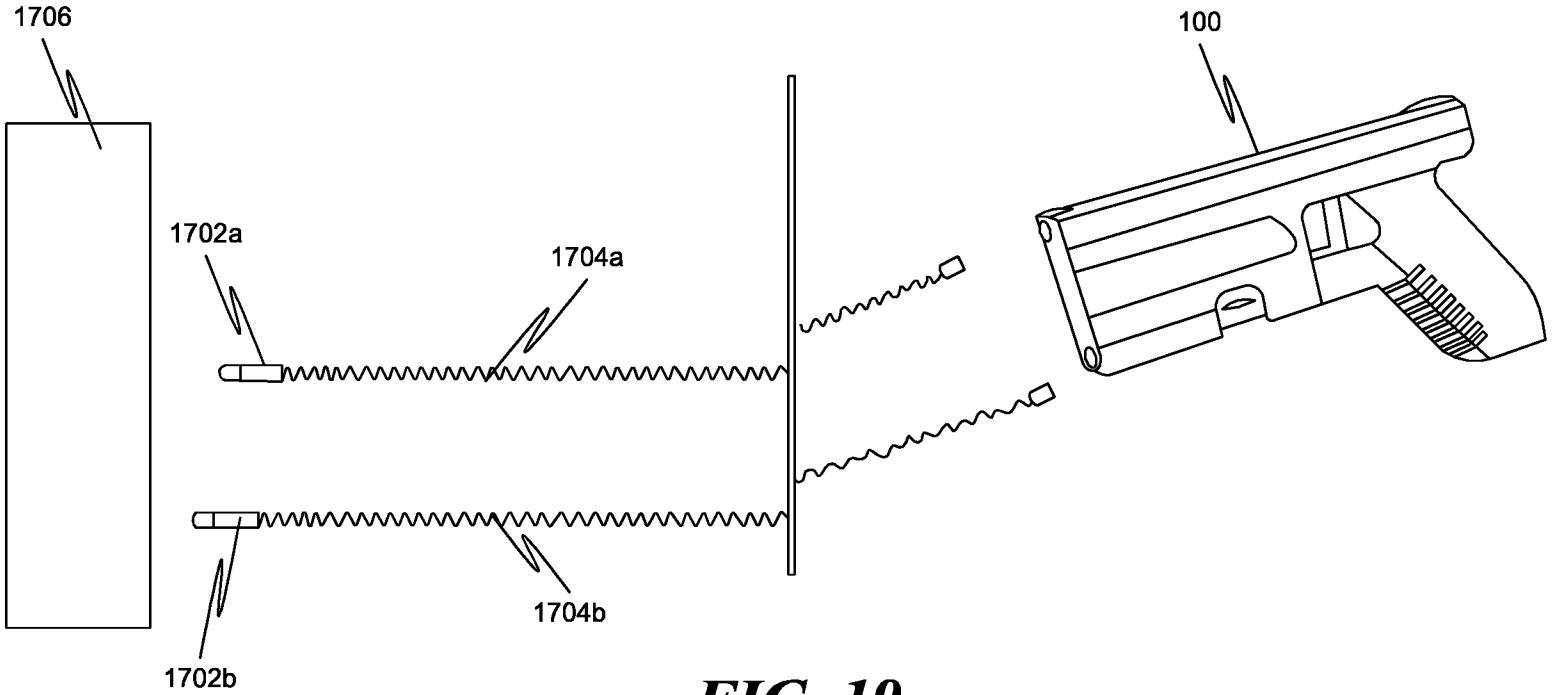
FIG. 19 is an illustration of projectiles without barbs rebounding from a target and releasing of connecting wires from a multiple shot projectile stun gun, in accordance with an embodiment.

FIG. 19 is an illustration of projectiles 1702 without barbs rebounding from a target 1706 and releasing of connecting wires 1704 from a multiple shot projectile stun gun 100, in accordance with an embodiment.

Figure 20:
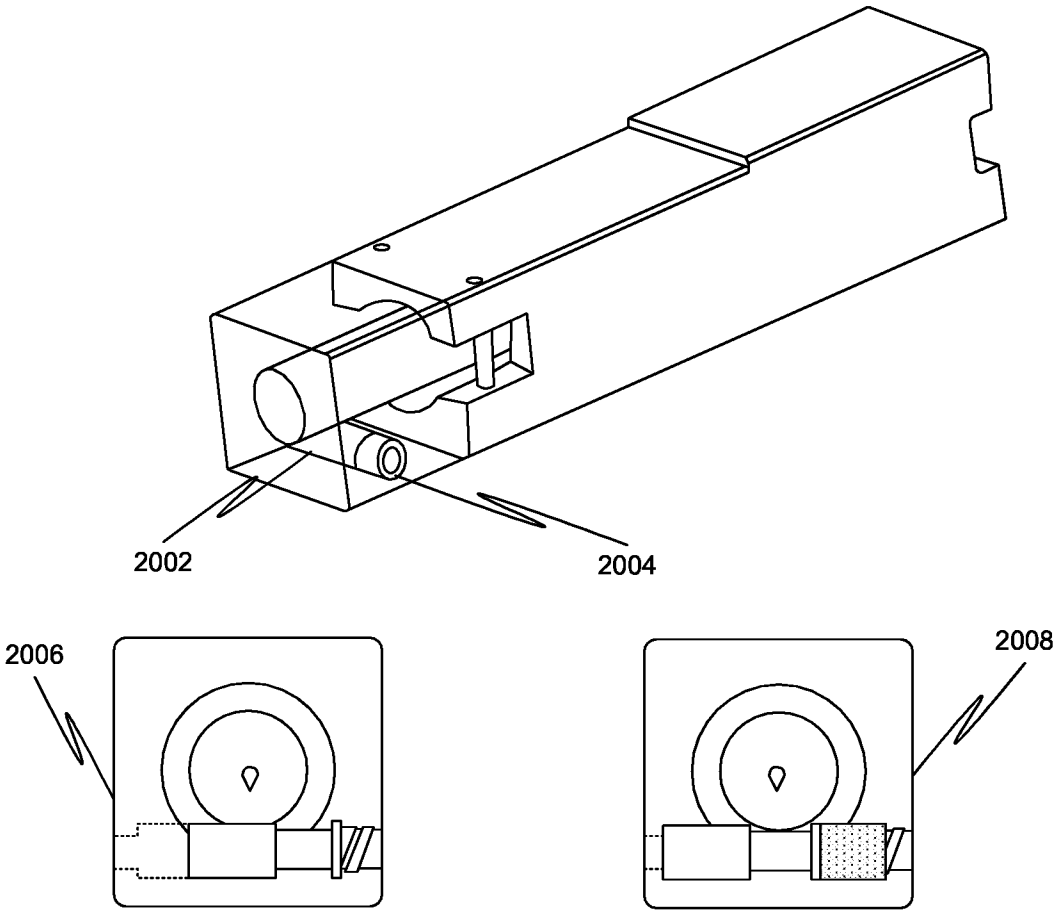
FIG. 20 is an illustration of use of electric charge to activate a pyrotechnic to release a cartridge propelled by springs, compressed gases, or other sources of stored energy from a multiple shot projectile stun gun, in accordance with an embodiment.

FIG. 20 is an illustration of use of electric charge to activate a pyrotechnic to release a cartridge 306 propelled by springs, compressed gases, or other sources of stored energy from a multiple shot projectile stun gun 100, in accordance with an embodiment. Additionally, the cartridge 306 may include a lock 2002 and a micro-pyrotechnic source 2004. Further, the lock 2002 may be in a closed state 2006 or an open state 2008.

According to an exemplary embodiment, a multiple shot projectile stun gun 100 (also referred to herein as "projectile stun gun 100" or "stun gun 100") is provided herein. The projectile stun gun 100 is different from those now in use by law enforcement and military. The concept of a "dual delivery magazine 302" coupled with multiple new cartridge 202 designs, multiple types of cartridges 202, multiple types of propulsion, and multiple firing modes results in a projectile stun gun 100 that can be operated in physical environments and "use of force" environments that were not possible before due to regulations and perceptions of the stun gun 100. The stun gun 100 of the present disclosure is practical for many applications for which current units are not considered because of the limitations imposed by having only one shot, long reload time, and only one type of cartridge 306 that has barbed projectiles. Additionally, the stun gun 100 not only provides precision delivery of an electrical charge for the purpose of incapacitation, but with this precision delivery it can activate other devices for the precision delivery of less lethal force or lethal force, which could include but not be limited to OC, light flash, noise, explosions, etc. This could be used in "surgical strike" scenarios for incapacitation or neutralization.

FIG. 1 illustrates a form factor of the stun gun 100 in accordance with an embodiment. This form factor is driven by a number of practical considerations including the electronics to provide current to the connecting wires and the projectile, the dual delivery cartridge system that is able to provide a separate projectile for either side of the positive and negative of the circuit that generates the incapacitating high voltage low amperage charge. Also with the concept of a dual delivery system for the projectiles it has been found that the operation of the unit is much smoother with the two projectiles emanating from a few inches apart as opposed to near the same point as with current designs. An additional advantage of the form factor is that as with current firearms, extended magazine 1202 to fire a high number of rounds as needed in an automatic mode may be inserted into the magazine 302.

FIG. 2 shows the form of the cartridges 202 which are very similar in size and shape to ammunition used and larger caliber handguns such as those used by law enforcement and military. This ammunition can either have a barb 708 at the end of the projectile as with current projectile stun gun 100 ammunition, or with the new design and the ability to deliver multiple shots in rapid fire it is possible to have ammunition that does not have a barb 708 at the end and thus would not be likely to penetrate the flesh of the person being incapacitated.

There have been many attempts to develop a means of delivering a charge similar to that from a projectile stun gun 100 to a target without the use of conducting wires. Attempts have included using conductive liquid but these attempts have all fell because a stream of liquid fire to the air always contains many air gaps and thus in reality is not a continuous stream but is actually a series of conductive areas with air gaps in between which results in tremendous resistance and thus cannot deliver the charge. Other attempts to make the projectile stun gun 100 into a futuristic weapon have included using a laser beam to conduct electricity. The basic idea is usually to ionize the air and use the air around the laser beam to conduct the electrical current. Attempts to use this approach have found that electrical energy can be conducted but the conductivity generated by the ionized air is very low and one can only conduct a few micro amps at best with this configuration. Numerous other ideas along these lines to form a conductor between the projectile stun gun 100 and the target have been explored but currently it appears that a solid conductor such as copper or other or other material that has very low resistance is the only workable solution. At the moment only metals such as copper, stainless steel, iron, silver, gold, etc. Provide the level of conductivity needed. However due to the fact that only small amperage is needed at very high voltage, the conductor can have a very small cross-section and has been demonstrated to work at very acceptable distances from a few feet up to tens of feet and being practical even up to 100 feet without increasing the cross-section above what is currently in use. Obviously with increased cross section this can probably be extended to much greater distances that would not be of interest for the normal close range projectile stun gun but would be of interest if projectile stun guns become of interest for longer ranges.

The need for a conductor connecting the projectile to the gun to provide the needed current is a need that will not go away without dramatic changes in technology. Current wires that serve as the conductor have usually been copper wire covered by insulation that may or may not withstand the electrical potential of the open air discharge of the stun gun 100 which is usually in the 40 to 50,000 range. The cartridges 202 of the present disclosure uses a very thin stainless steel wire that is wound either in a circular pattern or a FIG. 8 pattern. It has been demonstrated that it is possible to wind this wire and deploy the cartridge 202 without entanglement. Further it has been found that by using this stainless steel wire wound in a circular pattern that the wire acts as a spring which allows the wire to not be insulated if desired or it may be coated with insulation. Also it has been found that the un-insulated version of the wire used in the cartridges 202 in this disclosure has a unit length weight of less than 10% of the unit length weight of wire currently in use.

The ammunition for this unit has been designed and demonstrated in several forms as mentioned previously. The traditional means of propulsion in the past has either directly or indirectly involved a pyrotechnic in the past. The propulsion for the projectiles is no longer limited to pyrotechnic but can also be implemented with other mean, such as spring propulsion or with hydraulics. Pyrotechnic propulsion has the advantage of being able to have longer ranges; however the negative side of the longer ranges is that the projectile will potentially penetrate a human at close ranges. Further pyrotechnics are not allowed in some environments. Thus, the need for a compressed spring or other non-pyrotechnic to supply the propulsion energy is desirable in some situations even though it may be more difficult to achieve ranges beyond about 15 to 20 feet. Law enforcement considers handguns to be weapons that are normally used at a distance of around 20 feet or less in spite of high muzzle velocities and laser sights. Thus a spring propelled projectile with a range of 15 to 20 feet appears to be an acceptable alternative to a pyrotechnic propelled projectile.

Traditional projectile stun guns rely upon a single shot to hit the person that is to be incapacitated and to stop them. With a single shot unit it is not practical in a short timeline scenario that law enforcement encounters when confronting a hostile person, because realistically it may require three or four seconds to reload even under perfect conditions without stress. With this being the case it is essential that the single shot either attach to the clothing or penetrate the flesh of the person being fired at. With the projectile stun gun 100 of the present disclosure, the need for reload will go away because the stun gun 100 will have the capability of firing several or many shots if one is using projectiles that are equipped with barbs then the stun gun 100 would be fired in a semiautomatic fashion much the same as current semiautomatic side arms. In the semi-automatic mode the possibility of using one or more shots is very practical since there is no reload time and a second or third shot, or more, can be fired immediately if the previous shot misses. Once the projectile engages the target the unit will deliver pulsed charges through the wires at whatever rate the electronics are set, which is usually on the order of 15 to 20 pulses per second. This continues until the operator discontinues the electrical charge or until an automatic timer discontinues the charge.

With the constraint of a single shot removed and the possibility of as many shots available as a magazine 302 can supply, more widespread use is open for the projectile stun gun 100 if it is able to fire multiple shots much like a firearm. Research indicates that a person can be incapacitated with less than the 15 to 20 pulses per second that are used in most stun devices. Indications are that one can be incapacitated with as little as 4 to 6 pulses per second and certainly with around 10 pulses per second. The amount of time required for incapacitation varies from individual to individual but it has been found that normally at least 3 to 5 seconds or more of receiving charges is required. With this in mind it appears that if one is using the projectile stun gun 100 with the capabilities described herein and with blunt non-attaching projectiles, one can fire projectiles that are connected to the unit and allow the capacitor in the unit to discharge when the circuit is completed with the two projectiles and repeat this on the order of four to 10 or more times per second. This would indicate that the magazine 302 would be required to hold a minimum of 15 sets of projectiles up to a maximum of around 50 sets of projectiles. This is achievable with the dual delivery magazine 302 however if the number of projectiles reaches 50 sets, i.e., 100 projectiles. It may be necessary to have a dual delivery magazine 302 in a drum or "banana clip" type design.

According to some embodiments, the projectile stun gun 100 of the present disclosure is a less lethal weapon. With the use of multiple means of propulsion and the dual delivery system, the stun gun 100 can be used for of other less lethal applications as well. For example, the projectile can be loaded with OC spray, OC balls, chemicals or bright light flashes, chemicals for loud noises, (such as flash bang) or other devices that need precision delivery at close range to neutralize threats. In addition to being able to deliver precisely to a target, the electrical charge capability can also be used to activate the less lethal weapon at a precise point or time.

While aspects of the present invention can be described and claimed in a particular statutory class, such as the system statutory class, this is for convenience only and one of skill in the art will understand that each aspect of the present invention can be described and claimed in any statutory class. Unless otherwise expressly stated, it is in no way intended that any method or aspect set forth herein be construed as requiring that its steps be performed in a specific order. Accordingly, where a method claim does not specifically state in the claims or descriptions that the steps are to be limited to a specific order, it is no way appreciably intended that an order be inferred, in any respect. This holds for any possible non-express basis for interpretation, including matters of logic with respect to arrangement of steps or operational flow, plain meaning derived from grammatical organization or punctuation, or the number or type of aspects described in the specification.

Throughout this application, various publications are referenced. The disclosures of these publications in their entireties are hereby incorporated by reference into this application in order to more fully describe the state of the art to which this pertains. The references disclosed are also individually and specifically incorporated by reference herein for the material contained in them that is discussed in the sentence in which the reference is relied upon. Nothing herein is to be construed as an admission that the present invention is not entitled to antedate such publication by virtue of prior invention. Further, the dates of publication provided herein can be different from the actual publication dates, which can require independent confirmation.

The patentable scope of the invention is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed:

1. A multiple shot projectile stun gun with automatic and semi-automatic firing capabilities comprises:

a dual-barrel stun gun;

a magazine;

a magazine-receiving cavity;

the dual-barrel stun gun comprises a first barrel and a second barrel;

the magazine comprises a first clip assembly and a second clip assembly;

the first clip assembly and the second clip assembly each comprise a tubular body and a drive mechanism;

the tubular body comprises an open end and a closed end;

the drive mechanism being positioned within the tubular body;

the drive mechanism being connected adjacent to the closed end;

the open end of the first clip assembly being positioned coincident with the closed end of the second clip assembly;

the tubular body of the first clip assembly being laterally connected along the tubular body of the second clip assembly;

the magazine-receiving cavity traversing perpendicular into the first barrel and the second barrel;

the magazine being attached into the magazine-receiving cavity;

the open end of the first clip assembly being positioned coincident with the first barrel;

the open end of the second clip assembly being positioned coincident with the second barrel;

the drive mechanism comprises a spring and a follower;

the follower being slidably positioned along and within the tubular body; and the spring being connected in between the closed end of the tubular body and the follower.

2. The multiple shot projectile stun gun with automatic and semi-automatic firing capabilities as claimed in claim 1 comprises:

the dual-barrel stun gun further comprises an elongated housing body, a trigger mechanism, and a grip;

the first barrel and the second barrel being positioned parallel and offset to each other;

the first barrel and the second barrel being mounted within and along the elongated housing body;

the first barrel and the second barrel being positioned to a first end of the elongated housing body;

the grip being positioned adjacent to a second end of the elongated housing body;

the grip being laterally connected to the elongated housing body;

the trigger mechanism being positioned in between the first barrel and the grip;

the trigger mechanism being mounted to the elongated housing body; and the magazine-receiving cavity being positioned adjacent to the trigger mechanism, opposite the grip.

3. The multiple shot projectile stun gun with automatic and semi-automatic firing capabilities as claimed in claim 1 comprises:

the dual-barrel stun gun further comprises at least one battery;

the battery being mounted within a grip of the dual-barrel stun gun; and the battery being electrically connected to the first clip assembly, the second clip assembly, and the trigger mechanism of the dual-barrel stun gun.

4. The multiple shot projectile stun gun with automatic and semi-automatic firing capabilities as claimed in claim 1 comprises:

a voltage amplifier circuit;

the voltage amplifier circuit being mounted within the elongated housing body of the dual-barrel stun gun;

the voltage amplifier circuit being electrically connected in between the battery and the first clip assembly; and the voltage amplifier circuit being electrically connected in between the battery and the second clip assembly.

5. A multiple shot projectile stun gun with automatic and semi-automatic firing capabilities comprises:

a first clip assembly and a second clip assembly, each comprising a plurality of stun cartridges;

the plurality of stun cartridges being distributed along a tubular body;

the plurality of stun cartridges being positioned in between a drive mechanism and an open end of the tubular body;

each of the plurality of stun cartridges from the first clip assembly being oriented parallel to a first barrel of a dual-barrel stun gun;

each of the plurality of stun cartridges from the second clip assembly being oriented parallel to a second barrel of the dual-barrel stun gun;

each of the plurality of stun cartridges comprises a cylindrical body, a trailing wire, a retaining anchor, and a conductive portion;

the conductive portion being adjacently connected to a first end of the cylindrical body;

the retaining anchor being adjacently attached to a second end of the cylindrical body;

the trailing wire being wound about the cylindrical body from the first end to the second end;

the retaining anchor being electrically connected to the conductive portion by the trailing wire; and wherein the conductive portion is a semi-cylindrical ending.

6. The multiple shot projectile stun gun with automatic and semi-automatic firing capabilities as claimed in claim 5, wherein the conductive portion is a barb.

7. The multiple shot projectile stun gun with automatic and semi-automatic firing capabilities as claimed in claim 1 comprises:

the dual-barrel stun gun further comprises a first propulsion mechanism and a second propulsion mechanism;

the first propulsion mechanism being mechanically integrated in between the first clip assembly and the first barrel;

the second propulsion mechanism being mechanically integrated in between the second clip assembly and the second barrel;

the first propulsion mechanism and the second propulsion mechanism each being mechanically connected to a trigger mechanism of the dual-barrel stun gun.

8. The multiple shot projectile stun gun with automatic and semi-automatic firing capabilities as claimed in claim 7, wherein the first propulsion mechanism and the second propulsion mechanism are each pyrotechnic-based propulsion.

9. The multiple shot projectile stun gun with automatic and semi-automatic firing capabilities as claimed in claim 7, wherein the first propulsion mechanism and the second propulsion mechanism are each hydraulic-based propulsion.

10. The multiple shot projectile stun gun with automatic and semi-automatic firing capabilities as claimed in claim 7, wherein the first propulsion mechanism and the second propulsion mechanism are each spring-based propulsion.

* * * * *